US005952251A

United States Patent [19]

Jackson et al.

[11] Patent Number: 5,952,251

[45] **Date of Patent: *Sep. 14, 1999**

[54] COFORMED DISPERSIBLE NONWOVEN FABRIC BONDED WITH A HYBRID SYSTEM

[75] Inventors: David Martin Jackson, Roswell, Ga.; Pavneet Singh Mumick, Appleton, Wis.; Audrie Tomoko Ono, Atlanta, Ga.; William Seal Pomplun, Neenah, Wis.; Kenneth Yin Wang, Alpharetta, Ga.

[73] Assignee: Kimberly-Clark Corporation, Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/774,417

[22] Filed: Dec. 31, 1996

Related U.S. Application Data

[63] Continuation-in-part of application No. 08/497,629, Jun. 30, 1995, abandoned.

[51] Int. Cl.[6] ..... D04H 1/42

[52] U.S. Cl. ..... 442/340; 442/341; 442/342; 442/350

[58] Field of Search ..... 442/340, 341, 442/342, 350

[56] References Cited

U.S. PATENT DOCUMENTS

| | | | |
|---|---|---|---|
| 31,825 | 2/1861 | Mason et al. | 428/198 |
| 3,276,944 | 10/1966 | Levy | 161/150 |
| 3,338,992 | 8/1967 | Kinney | 264/24 |
| 3,341,394 | 9/1967 | Kinney | 161/72 |
| 3,502,538 | 3/1970 | Peterson | 161/150 |
| 3,502,763 | 3/1970 | Hartmann | 264/210 |

(List continued on next page.)

FOREIGN PATENT DOCUMENTS

| | | | |
|---|---|---|---|
| 803714 | 1/1969 | Canada . | |
| 0003186 | 7/1979 | European Pat. Off. . | |
| 0080382 | 6/1983 | European Pat. Off. . | |
| 0156160 | 10/1985 | European Pat. Off. . | |
| 0773315 | 5/1997 | European Pat. Off. | D04H 1/42 |
| 6248548 | 6/1994 | Japan . | |
| 1199190 | 7/1970 | United Kingdom | D04H 1/42 |
| 9702376 | 1/1997 | WIPO | D04H 1/42 |

OTHER PUBLICATIONS

NRL Report 4364, "Manufacture of Superfine Organic Fibers" by V.A. Wente, E.L. Boone, and C.D. Fluharty.

(List continued on next page.)

*Primary Examiner*—Richard Weisberger
*Attorney, Agent, or Firm*—Bernstein & Associates, P.C.

[57] ABSTRACT

A water-dispersible coformed fibrous nonwoven fabric structure comprising a primary reinforcing polymer material, preferably capable of being meltspun; a secondary reinforcing polymer material having an average fiber length less than or equal to about 15 mm and preferably having a softening point at least about 30° C. lower than the softening point of the primary reinforcing polymer; and, an absorbent material, such as pulp or a superabsorbent. The fabric structure maintains desired tensile strength and softness while being water-dispersible and flushable. The fabric produced can be incorporated into an article and can be flushed down a commode. The fabric is flushable when placed in water, with agitation, if necessary, and will disperse into unrecognizable pieces without clogging conventional plumbing or piping.

A method of producing the fabric structure comprises mixing the secondary reinforcing material and absorbent material and injecting this coform blend into a stream of meltspun primary reinforcing fibers. After a web structure has been established, the structure is exposed to thermal or ultrasonic energy sufficient to soften and bond the secondary reinforcing material fibers, but not to soften the primary reinforcing material fibers. An embossed pattern can be printed on the structure.

23 Claims, 2 Drawing Sheets

U.S. PATENT DOCUMENTS

| | | | |
|---|---|---|---|
| 3,542,615 | 11/1970 | Dobo et al. | 156/181 |
| 3,616,797 | 11/1971 | Champaigne, Jr. et al. | 128/290 |
| 3,654,928 | 4/1972 | Duchane | 128/290 |
| 3,676,242 | 7/1972 | Prentice | 156/62.4 |
| 3,692,618 | 9/1972 | Dorschner et al. | 161/72 |
| 3,793,678 | 2/1974 | Appel | 19/156.3 |
| 3,802,817 | 4/1974 | Matsuki et al. | 425/66 |
| 3,849,241 | 11/1974 | Butin et al. | 161/169 |
| 3,855,046 | 12/1974 | Hansen et al. | 161/150 |
| 3,913,579 | 10/1975 | Srinvasan et al. | 128/290 |
| 3,971,373 | 7/1976 | Braun | 128/146.2 |
| 4,100,324 | 7/1978 | Anderson et al. | 428/288 |
| 4,117,187 | 9/1978 | Adams et al. | 428/286 |
| 4,164,595 | 8/1979 | Adams et al. | 427/341 |
| 4,207,367 | 6/1980 | Baker, Jr. | 428/171 |
| 4,242,408 | 12/1980 | Evani et al. | 428/290 |
| 4,309,469 | 1/1982 | Varona | 428/74 |
| 4,340,563 | 7/1982 | Appel et al. | 264/518 |
| 4,343,133 | 8/1982 | Daniels et al. | 53/431 |
| 4,343,134 | 8/1982 | Davidowich et al. | 53/431 |
| 4,343,403 | 8/1982 | Daniels et al. | 206/812 |
| 4,374,888 | 2/1983 | Bornslaeger | 428/198 |
| 4,419,403 | 12/1983 | Varona | 428/288 |
| 4,429,001 | 1/1984 | Kolpin et al. | 428/283 |
| 4,604,313 | 8/1986 | McFarland et al. | 428/172 |
| 4,610,743 | 9/1986 | Salmeen et al. | 156/183 |
| 4,749,423 | 6/1988 | Vaalburg et al. | 156/181 |
| 4,902,559 | 2/1990 | Eschwey et al. | 428/224 |
| 5,009,747 | 4/1991 | Viazmensky et al. | 162/115 |
| 5,041,252 | 8/1991 | Fujii et al. | 264/176.1 |
| 5,102,668 | 4/1992 | Eichel et al. | 424/490 |
| 5,108,820 | 4/1992 | Kaneko et al. | 428/198 |
| 5,108,827 | 4/1992 | Gessner | 428/219 |
| 5,292,581 | 3/1994 | Viazmensky et al. | 428/288 |
| 5,336,552 | 8/1994 | Strack et al. | 428/224 |
| 5,350,624 | 9/1994 | Georger et al. | 428/219 |
| 5,382,400 | 1/1995 | Pike et al. | 264/168 |
| 5,500,068 | 3/1996 | Srinivasan et al.. | 156/148 |
| 5,500,281 | 3/1996 | Srinivasan et al. | 428/288 |
| 5,509,913 | 4/1996 | Yeo | 604/364 |

OTHER PUBLICATIONS

NRL Report 5265, "An Improved Device for the Formation of Super–Fine Thermoplastic Fibers" by K.K. Lawrence, R.T. Lucas and J.A. Young.

Polymer Blends and Composites by John A. Manson and Leslie H. Sperling, copyright 1976 by Plenum Press, a division of Plenum Publishing Corp. of New York, IBSN 0–306–30831–2, pp. 273–277.

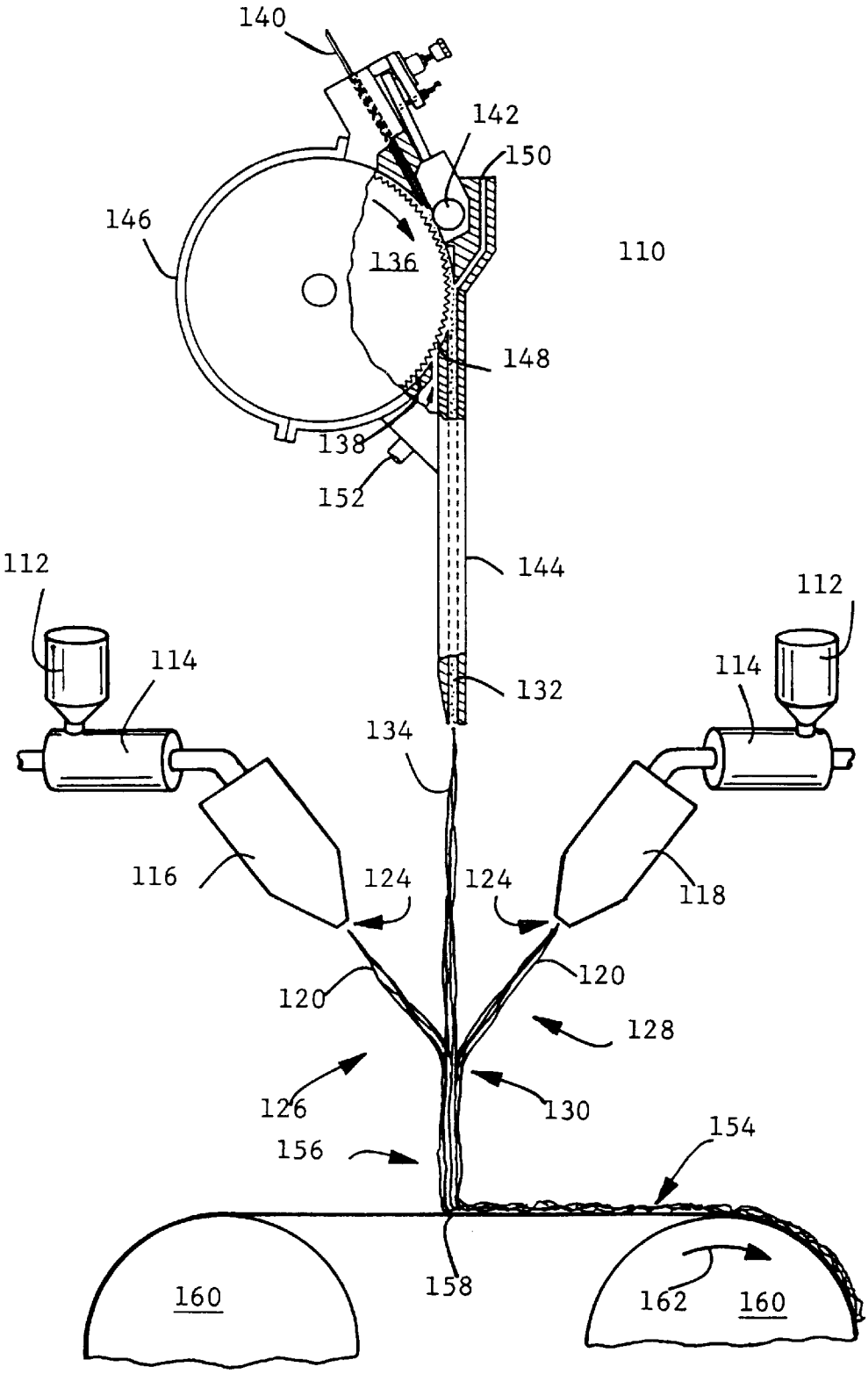
FIG. #3

COFORMED DISPERSIBLE NONWOVEN FABRIC BONDED WITH A HYBRID SYSTEM

CROSS-REFERENCE TO RELATED APPLICATION

The present invention is a continuation-in-part of application entitled "WATER-DISPERSIBLE FIBROUS NONWOVEN COFORM COMPOSITES, by Jackson et al., Ser. No. 08/497,629, filed Jun. 30, 1995, now abandoned, and commonly assigned to the assignee of the present invention.

FIELD OF THE INVENTION

The present invention relates to water-dispersible coformed fibrous nonwoven composite structures comprising a primary reinforcing meltspun polymer fiber, a secondary reinforcing staple polymer fiber, and an absorbent material.

BACKGROUND OF THE INVENTION

Wet wipes are sheets of fabric stored in a solution prior to use and normally used to wipe the skin. The most common types of wet wipes are baby wipes, typically used to clean the seat area during a diaper change, and adult wipes, used to clean hands, face and bottom. Wet wipes are often made from bonded nonwoven fabrics that have sufficient tensile strength that they will not fall apart during manufacturing or in use, yet have desirable softness characteristics for use on skin in tender areas. Such nonwoven fabrics are commonly manufactured by meltspun processes, such as meltblown and spunbond processes, known to those skilled in the art, because meltspun fabrics can be produced that have the requisite tensile strength and softness.

Bonding of nonwoven materials generally builds strength and integrity in nonwoven fabrics. Many conventional bonding systems are used to make nonwoven fabrics, such as, but not limited to, thermal bonding, resin bonding (aqueous or melt), hydroentanglement, and mechanical bonding. These broad classifications can be subdivided into overall treatment or zone treatment such as dots, lines or small areas of patterns. Further, the degree of bonding can be controlled. A high degree of bonding by higher percentage add on or higher energy input usually builds higher strengths and vice versa. However, bonding normally negates the ability for post-use disposal by disintegration and dispersion during toilet flushing.

Many of the items or products into which bonded meltspun materials are incorporated are generally regarded as being limited use disposable products. By this it is meant that the product or products are used only a limited number of times and in some cases only once before being discarded. With increasing concerns over solid waste disposal, there is now an increasing need for materials that are, for example, either recyclable or disposable through other mechanisms besides incorporation into landfills. One possible alternative means of disposal for many products, especially in the area of personal care absorbent products and wipers, is by flushing them into sewage disposal systems. As will be discussed in greater detail below, flushable means that the material must not only be able to pass through a commode without clogging it, but the material must also be able to pass through the sewer laterals between a house (or other structure housing the commode) the main sewer system without getting caught in the piping, and to disperse into small pieces that will not create a nuisance to the consumer or in the sewer transport and treatment process.

In recent years, more sophisticated approaches have been devised to impart dispersability. Chemical binders that are either melt processable or aqueous and emulsion processable have been developed. The material can have high strength in their original storage environment, but quickly lose strength by debonding or dispersing when placed in a different chemical (e.g., pH or ion concentration) environment, such as by flushing down a commode with fresh water. It would be desirable to have a bonding system that would produce a fabric having desirable strength characteristics, yet be able to disperse or degrade after use into small pieces. As machines for producing such bonded nonwoven fabrics are usually designed to work with one bonding system, hybrid bonding systems are generally unknown in the industry.

U.S. Pat. Nos. 4,309,469 and 4,419,403, both issued to Varona describe a dispersible binder of several parts. Reissue Patent no. 31,825 describes a two-stage heating process (preheat by infrared) to calendar bond a nonwoven consisting of thermoplastic fibers. Although offering some flexibility, this is still a single thermal bonding system. U.S. Pat. No. 4,207,367 issued to Baker, describes a nonwoven which is densified at individual areas by cold embossing. The chemical binders are sprayed on and the binders preferentially migrate to the densified areas by capillary action. The non-densified areas have higher loft and remain highly absorbent. However, it is not a hybrid bonding system because the densification step is not strictly a bonding process. U.S. Pat. No. 4,749,423, issued to Vaalburg et al., describes a two stage thermal bonding system. In the first stage, up to 7% of polyethylene fibers in a web is fused to provided temporary strength to support transfer to the next stage. In the second stage the primary fibers are thermally bonded to give the web its overall integrity. This process in two distinct stages does not make the web have built in areas of strength and weakness. It is not suitable as a dispersible material.

Several patents describe hybrid bonding systems, but are for sanitary napkin covers. For example, see U.S. Pat. No. 3,654,924, to Duchane, U.S. Pat. No. 3,616,797, issued to Champagne et al., and U.S. Pat. No. 3,913,574, issued to Srinvasan et al. The important difference is that these products are designed to be stored dry and to have very limited wet strength for a short duration during use. In a wet wipe there remains a need for prolonged wet strength in a storage solution.

Fibrous nonwoven materials and fibrous nonwoven composite materials are widely used as products or as components of products because they can be manufactured inexpensively and can be made to have specific characteristics. One approach has been to mix thermoplastic polymer fibers with one or more types of fibrous material and/or particulates. The mixtures are collected in the form of fibrous nonwoven web composites which may be further bonded or treated to provide coherent nonwoven composites that take advantage of at least some of the properties of each component. For example, U.S. Pat. No. 4,100,324 issued Jul. 11, 1978, to Anderson et al. discloses a nonwoven fabric which is generally a uniform admixture of wood pulp and meltblown thermoplastic polymer fibers. U.S. Pat. No. 3,971,373 issued Jul. 7, 1976, to Braun discloses a nonwoven material which contains meltblown thermoplastic polymer fibers and discrete solid particles. According to this patent, the particles are uniformly dispersed and intermixed with the meltblown fibers in the nonwoven material. U.S. Pat. No. 4,429,001 issued Jan. 31, 1984, to Kolpin et al. discloses an absorbent sheet material which is a combination of meltblown thermoplastic polymer fibers and solid superabsorbent particles.

The superabsorbent particles are disclosed as being uniformly dispersed and physically held within a web of the meltblown thermoplastic polymer fibers. European Patent Number 0080382 to Minto et al. published Jun. 1, 1983, and European Patent Number 0156160 to Minto et al. published Oct. 25, 1985, also disclose combinations of particles such as superabsorbents and meltblown thermoplastic polymer fibers. U.S. Pat. No. 5,350,624 to Georger et al. issued Sep. 27, 1994, discloses an abrasion-resistant fibrous nonwoven structure composed of a matrix of meltblown fibers having a first exterior surface, a second exterior surface and an interior portion with at least one other fibrous material integrated into the meltblown fiber matrix. The concentration of meltblown fibers adjacent to each exterior surface of the nonwoven structure is at least about 60 percent by weight and the concentration of meltblown fibers in the interior portion is less than about 40 percent by weight. Many of the aforementioned admixtures are referred to as "coform" materials because they are formed by combining two or more materials in the forming step into a single structure. Coform materials can also be produced by a spunbond process, such as is disclosed in U.S. Pat. No. 4,902,559 to Eschwey et al. issued Feb. 20, 1990.

Currently, one common method of meltblown formation of coform nonwoven material involves injecting an amount of cellulose fibers or blends of cellulose fibers and staple fibers into a molten stream of meltblown fibers. Coform material injected into the fiber stream becomes entrapped or stuck to the molten fibers, which are subsequently cooled or set. In a further step the fabric can be bonded by thermally or ultrasonically melting the meltblown fibers to cross-bond the fibers together, imparting desired tensile strength. Such bonding treatment also reduces softness because it reduces freedom of movement between the meltblown fibers in the web structure. Thus, the imparting of strength has, heretofore resulted in a diminution of softness (absent additional steps of softening, which affect material properties and add to production costs). Moreover, because the meltblown fibers are preferentially used in water dispersible fabrics because of the low denier fiber produced, fiber strength is compromised. It would be desirable to produce a fabric having desirable strength and softness characteristics, yet be water dispersible.

Coform engineered composites can be used in a wide variety of applications including absorbent media for aqueous and organic fluids, filtration media for wet and dry applications, insulating materials, protective cushioning materials, containment and delivery systems and wiping media for both wet and dry applications. Many of the foregoing applications can be met, to varying degrees, through the use of more simplified structures such as absorbent structures wherein only wood pulp fibers are used. This has commonly been the case with, for example, the absorbent cores of personal care absorbent products such as diapers. Wood pulp fibers when formed by themselves tend to yield nonwoven web structures which have very little mechanical integrity and a high degree of collapse when wetted. The advent of coform structures which incorporated thermoplastic meltblown fibers, even in small quantities, greatly enhanced the properties of such structures including both wet and dry tensile strength. The same enhancements were also seen with the advent of coform wiping sheets.

The very reason why many coform materials provide increased benefits over conventional materials, i.e., the meltblown thermoplastic fiber matrix, is the same reason why such materials are more difficult to recycle or flush. Many wood pulp fiber-based products can be recycled by hydrating and repulping the reclaimed wood pulp fibers. However, in coform structures the thermoplastic meltblown fibers do not readily break-up. The meltblown fibers are hard to separate from the wood pulp fibers, and they remain substantially continuous thereby giving rise to the possibility of clogging or otherwise damaging recycling equipment such as repulpers. From the standpoint of flushability, the current belief is that to be flushable, a product must be made from very small and/or very weak fibers so that the material will readily break-up into smaller pieces when placed in quantities of water such as are found in toilets and, again due to the nature of the fibers, when flushed will not be entrained or trapped within the piping of conventional private and public sewage disposal systems. Many of these systems, especially sewer laterals, may have many protrusions within the pipes such as tree roots which will snag any type of material which is still relatively intact. Such would be the case with conventional non-water-dispersible meltblown thermoplastic fibers in coform materials. As a result, for at least the foregoing reasons, there is a need for a coform material which has the potential for being more user friendly with respect to recycling processes and disposal through alternative means to landfills such as, for example, flushing. Accordingly, it is an object of the present invention to provide such a material.

SUMMARY OF THE INVENTION

The present invention provides a water-dispersible fibrous nonwoven composite structure comprising a primary reinforcing polymer material capable of being meltspun into fibers; a secondary reinforcing material comprising staple polymer fibers having an average fiber length less than or equal to about 15 mm; and, an absorbent material, such as pulp. Preferably, secondary reinforcing material has a softening point about 50° C. below to about 50° C. above, more preferably equal to or at least about 30° C. lower than the softening point of the primary reinforcing material.

In a preferred embodiment, the primary reinforcing material is present in a concentration of from about 30% to about 35% the secondary reinforcing material is present in a concentration of from about 5% to about 8%, and the absorbent material is present in a concentration of from about 50% to about 55%. A method of forming a water-dispersible fibrous nonwoven composite structure comprises providing a primary reinforcing material comprising polymer fibers; providing a secondary reinforcing material comprising polymer fibers, the secondary reinforcing material polymer fibers having an average fiber length less than or equal to about 15 mm; providing an absorbent material; mixing the secondary reinforcing material with the absorbent material; forming a fiber stream composed of meltspun primary reinforcing material; adding an effective amount of the mixture of step d) to the fiber stream; attenuating the fiber stream of step f); forming a fibrous nonwoven structure from the fiber stream of step g); and, exposing the nonwoven structure of step h) to a source of energy selected from the group consisting of thermal energy and ultrasonic energy such that the secondary reinforcing fibers soften while the primary reinforcing material remains substantially unsoftened.

The limited secondary reinforcing material fiber length reduces the tendency of the final fabric produced to twist or "rope" when flushed down a commode. Also, the limited fiber length promotes dispersion in water into small pieces. The softening point differential between the primary and secondary reinforcing fibers allows for only one or the other material to soften during the thermal or ultrasonic bonding step of fabric formation. This selective softening point control produces a fabric having only one of the components bonding, while the other component fibers maintain freedom of movement, thus producing a fabric having desirable tensile strength yet softness properties.

Accordingly, it is an object of the present invention to provide a nonwoven fabric structure having desirable wet tensile strength characteristics, while being water dispersible.

It is another object of the present invention to provide a wet wipe material capable of maintaining strength during use and being flushable in an ordinary commode.

It is a further object of the present invention to provide a wet wipe material capable of dispersing in water to form pieces that are less than about 25 millimeters in diameter and are small enough to prevent problems in a sewage transport system.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which:

FIG. 3 is a partial schematic side elevation of another possible method and apparatus for producing water-dispersible fibrous nonwoven composite structures according to the present invention.

DESCRIPTION OF THE PREFERRED EMBODIMENTS

DEFINITIONS

Figure 1:
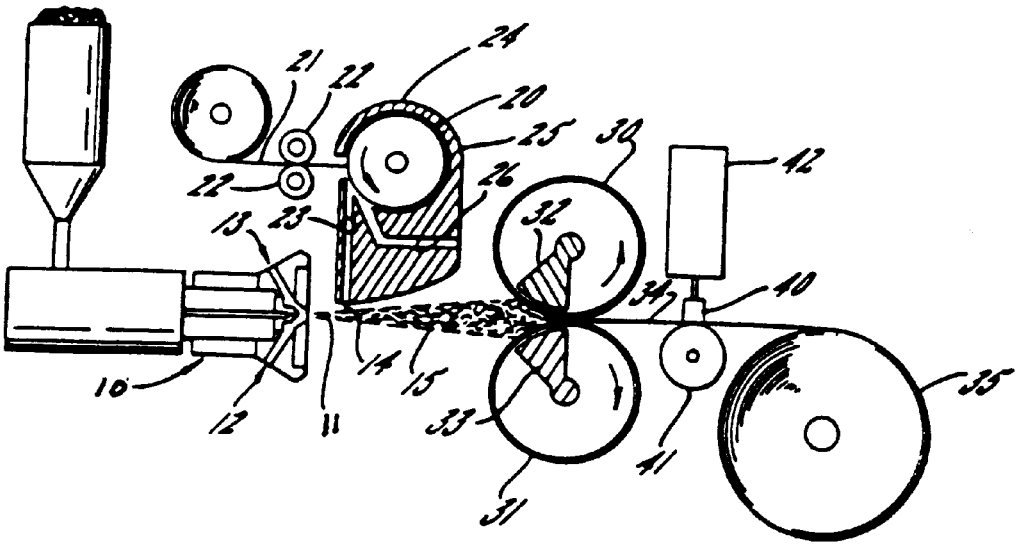
FIG. 1 is a schematic side elevation, partially in section, of a possible method and apparatus for producing water-dispersible fibrous nonwoven composite structures according to the present invention.

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns or micrometers. (Note that to convert from osy to gsm, multiply osy by 33.91).

As used herein the term "microfibers" means small diameter fibers having an average diameter not greater than about 75 micrometers, for example, having an average diameter of from about 0.5 micrometers to about 50 micrometers, or more particularly, microfibers may have an average diameter of from about 2 micrometers to about 40 micrometers. Another frequently used expression of fiber diameter is denier, which is defined as grams per 9000 meters of a fiber and may be calculated as fiber diameter in micrometers squared, multiplied by the density in grams/cc, multiplied by 0.00707. A lower denier indicates a finer fiber and a higher denier indicates a thicker or heavier fiber. For example, the diameter of a polypropylene fiber given as 15 micrometers may be converted to denier by squaring, multiplying the result by 0.89 g/cc and multiplying by 0.00707. Thus, a 15 micrometer polypropylene fiber has a denier of about 1.42 ($152\times0.89\times0.00707=1.415$). Outside the United States the unit of measurement is more commonly the "tex", which is defined as the grams per kilometer of fiber. Tex may be calculated as denier/9.

As used herein the term "meltblown fibers" means fibers formed by extruding a molten thermoplastic material through a plurality of fine, usually circular, die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Buntin. Meltblown fibers are microfibers which may be continuous or discontinuous, are generally smaller than 10 micrometers in average diameter, and are generally tacky when deposited onto a collecting surface.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configuration of the material. These configurations include, but are not limited to isotactic, syndiotactic and random symmetries.

As used herein the term "monocomponent" fiber refers to a fiber formed from one or more extruders using only one polymer. This is not meant to exclude fibers formed from one polymer to which small amounts of additives have been added for coloration, anti-static properties, lubrication, hydrophilicity, etc. These additives, e.g. titanium dioxide for coloration, are generally present in an amount less than 5 weight percent and more typically about 2 weight percent.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook Polymer Blends and Composites by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, "ultrasonic bonding" means a process performed, for example, by passing the fabric between a sonic horn and anvil roll as illustrated in U.S. Pat. No. 4,374,888 to Bornslaeger.

As used herein "thermal point bonding" involves passing a fabric or web of fibers to be bonded between a heated calendar roll and an anvil roll. The calendar roll is usually, though not always, patterned in some way so that the entire fabric is not bonded across its entire surface. As a result, various patterns for calendar rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches (0.584 mm), a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g. like a window screen. Typically, the percent bonding area varies from around 10% to around 30% of the area of the fabric laminate web. As in well known in the art, the spot bonding further holds the composite together as well as imparts integrity to the composite nonwoven by bonding filaments and/or fibers within the composite structure.

As used herein the term "flushable" means that an article, when flushed down a conventional commode containing approximately room temperature water, will pass through the commode plumbing, the sewer laterals (i.e., the piping between the house or building and the main sewer line) without clogging, and disperse into pieces no larger than about 25 mm in diameter.

As used herein the term "dispersible" means that the fibers of a material are capable of debonding, resulting in the material breaking down into smaller pieces than the original sheet. Debonding is generally a physical change of scattering or separation, as compared to a state change, such as dissolving, wherein the material goes into solution, e.g., a water soluble polymer dissolving in water.

As used herein the term "coform" means continuous melt-spun reinforcing fibers intermixed with shorter absorbent fibers such as staple length fibers and wood pulp fiber particulates, such as superabsorbents.

As used herein the term "fibrous nonwoven composite structure" refers to a structure of individual fibers or filaments with or without particulates which are interlaid, but not in an identifiable repeating manner. Nonwoven structures such as, for example, fibrous nonwoven webs have been formed in the past, by a variety of processes known to those skilled in the art including, for example, meltblowing and meltspinning processes, spunbonding processes, bonded carded web processes and the like.

As used herein, the term "water dispersible" or "water disintegratable" refers to a fibrous nonwoven composite structure which when placed in an aqueous environment will, with sufficient time, break apart into smaller pieces. As a result, the structure once dispersed may be more advantageously processable in recycling processes, for example, septic and municipal sewage treatment systems. If desired, such fibrous nonwoven structures may be made more water-dispersible or the dispersion may be hastened by the use of agitation and/or certain triggering means further described below. The actual amount of time will depend at least in part upon the particular end-use design criteria. For example, in the sanitary napkin embodiments described below, the fibers break apart in less than a minute. In other applications, longer times may be desirable.

As used herein the term "fibrous nonwoven composite structure" refers to a structure of individual fibers or filaments with or without particulates which are interlaid, but not in an identifiable repeating manner.

As used herein, the term "softening point" or "softening temperature" is defined according to the ASTM (Vicat) Test Method D-1525, which is known to those skilled in the art.

DETAILED DESCRIPTION

The present invention is directed to a water dispersible fibrous coformed nonwoven composite structure comprising a primary reinforcing polymer; a secondary reinforcing polymer fiber having a length no longer than about 15 mm, and which preferably (although not mandatorily) has a softening point at least about 30° C. less than the primary reinforcing polymer; and, an absorbent material.

The primary reinforcing polymer is preferably a meltspun fiber. By "meltspun" it is meant a fiber which is formed by a fiber-forming process which yields longer, more continuous fibers (generally in excess of 7.5 centimeters) such as are made by the meltblown and spunbond processes. Examples of two such water-dispersible reinforcing fibers are meltblown fibers and spunbond fibers. Meltblown fibers are formed by extruding molten thermoplastic material through a plurality of fine, usually circular, die capillaries as molten threads or filaments into a heated high velocity gas stream such as air, which attenuates the filaments of molten thermoplastic material to reduce their diameters. Thereafter, the meltblown fibers are carried by the high velocity gas stream and are deposited on a collecting surface to form a web of randomly dispersed meltblown fibers. The meltblown process is well-known and is described in various patents and publications, including NRL Report 4364, "Manufacture of Super-Fine Organic Fibers" by B. A. Wendt, E. L. Boone and C. D. Fluharty; NRL Report 5265, "An Improved Device For The Formation of Super-Fine Thermoplastic Fibers" by K. D. Lawrence, R. T. Lukas, J. A. Young; U.S. Pat. No. 3,676,242, issued Jul. 11, 1972, to Prentice; and U.S. Pat. No. 3,849,241, issued Nov. 19, 1974, to Buntin, et al. Such meltblown fibers can be made in a wide variety of diameters. Typically, such fibers will have an average diameter of not greater than about 100 micrometers and usually not more than 15 micrometers.

Spunbond fibers are formed by extruding a molten thermoplastic material as filaments from a plurality of fine, usually circular, capillaries in a spinneret with the diameter of the extruded filaments then being rapidly reduced, for example, by non-eductive or eductive fluid-drawing or other well-known spunbonding mechanisms. The production of spunbond nonwoven webs is illustrated in patents such as Appel et al., U.S. Pat. No. 4,340,563; Matsuki et al., U.S. Pat. No. 3,802,817; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent Number 803,714.

The primary reinforcing material may be made of a polymer such as, but not limited to, polyesters, copolyesters, polyamides, copolyamides, polyethylene terephthalates, vinyl alcohols, co-poly(vinyl alcohol), acrylates, methacrylates, cellulose esters, a blend of at least two of these materials, and copolymers of acrylic acid and methacrylic acid, and the like. The main requirement of the material is that it be meltable and water dispersible.

A preferred polymer is a proprietary blend of a polyamide provided as code number NP 2068 by H. B. Fuller Company of St. Paul, Minn. Code number NP 2074 is also a preferred material that is similar to NP 2068. The viscosity of the NP 2068 polymer was 95 Pascal-seconds at a temperature of 204° C. The softening temperature range of the NP 2068 polymer was 128° C.–145° C. but it processed best at 210° C. to make meltblown microfibers. The NP 2068 polymer is described in greater detail in the Examples set forth below.

The polymer fibers are preferably less than about 5 denier. Another usable material is a proprietary copolyester blend provided as code number NS-70-4395, available from National Starch and Chemical Company, Bridgewater, N.J. Alternatively, a blend of polymers can be utilized, which may provide different composite composition control features depending on the polymers used.

The secondary reinforcing material of the present invention is made of a thermoplastic polymer and formed by any of a number of known processes, such as, but not limited to meltspun techniques. After continuous fibers are drawn they are cut to form shorter lengths of fibers, commonly called staple fibers.

There are many thermoplastic short cut staple fibers currently available which can be made from a variety of polymers including, but not limited to, polyolefins, polyesters, polyether block amides, nylons, poly(ethylene-co-vinyl acetate), polyurethanes, co-poly(ether/ester), and bicomponent and multicomponent materials made therefrom, and the like. In addition, several different types and/or sizes of such fibers may be used in the coform structure. A preferred polymer is a polyester available from Minifibers Ltd., Johnson City, Tenn., which is a 5 denier by 6 mm fiber having a softening point of 88° C. (190° F.). Alternatively, the secondary reinforcing material can be a bicomponent or multi-component material, a conjugate material or a blend of these. A possible bicomponent material is the Minifibers polyester as the sheath and a polypropylene, polyethylene or polyethylene terephthalate as a core.

It is critical that the secondary reinforcing polymer fibers are less than about 15 mm long (about 0.6 inches), and more preferably less than about 6.35 mm (about 0.25 inches). This short fiber length minimizes the possibility of tangling and twisting (also known as roping) of the final fabric product in plumbing and piping. Secondary reinforcing fiber material length in excess of about 15 mm produces water-dispersible pieces of fabric larger than is desirable and can tangle and twist in plumbing.

Additionally, it is preferable (though not mandatory) that at least one component of the secondary reinforcing polymer material have a softening point at least approximately 30° C. less than the primary reinforcing polymer. In a preferred embodiment, the secondary reinforcing material has a softening point about 50° C. above to about 50° C. below the softening point of the primary reinforcing material. The secondary reinforcing material preferably has a softening point of from about 50° C. to about 200° C., as measured by the ASTM (Vicat) Test Method D-1525. Alternatively, the primary reinforcing material may have a softening point about 50° C. above to about 50° C. below the softening point of the secondary reinforcing material. In a more narrow preferred embodiment the primary reinforcing material has a softening point of about 57° C. and the secondary material has a softening point of about 88° C. The important feature is that the primary and secondary materials have softening points that are markedly different so that during a softening process (e.g., by application of thermal or ultrasonic energy) only one of the polymers softens and bonds, while the other material does not materially soften. This is important during the overbond step in the fabric formation process as will be discussed in greater detail below.

The absorbent material of the present invention is commonly referred to as pulp or pulp fibers. Pulp fibers are generally obtained from natural sources such as woody and non-woody plants. Woody plants include, for example, deciduous and coniferous trees. Non-woody plants include, for example, cotton, flax, esparto grass, milkweed, straw, jute, and bagasse. In addition, synthetic wood pulp fibers are also available and may be used with the present invention. Wood pulp fibers typically have lengths of about 0.5 to 10 millimeters and a length-to-maximum width ratio of about 10:1 to 400:1. A typical cross-section has an irregular width of about 30 micrometers and a thickness of about 5 micrometers. One wood pulp suitable for use with the present invention is Kimberly-Clark CR-54 wood pulp from the Kimberly-Clark Corporation of Neenah, Wis.

In addition to the wood pulp fibers, the fibrous nonwoven structure according to the present invention may employ superabsorbent materials. Superabsorbent materials are absorbent materials capable of absorbing at least 10 grams of aqueous liquid (e.g., distilled water) per gram of absorbent material while immersed in a liquid for four hours and which will hold substantially all of the absorbed liquid while under a compression force of up to about 10 kiloPascals (kPa). Superabsorbent materials are produced in a wide variety of forms including, but not limited to, particles, fibers and flakes. Such superabsorbent materials may be used in the present invention in combination with the water-dispersible reinforcing fibers and shorter absorbent fibers or in lieu of the staple fibers. The particulates may be, for example, charcoal, clay, starches, and/or hydrocolloid (hydrogel) particulates.

Due to the longer, more continuous nature of the fibers formed by the foregoing meltblown and spunbonding processes, such fibers and resultant nonwoven webs including coform webs do not readily break apart due to the inherent tenacity of the meltblown and/or spunbond fibers. As a result, coform materials which are predominantly wood pulp fibers but which still contain longer fibers such as polyolefin meltblown fibers are difficult to reclaim in such apparatus as repulpers. In addition, these longer, more continuous fibers also tend to hang up in or on protuberances in sewer laterals thereby making such composite materials difficult to transfer through the sewage treatment system. The fibrous nonwoven composite structures according to the present invention use a water dispersible reinforcing fiber which may be made, for example, by the aforementioned and described meltblowing and spunbonding processes.

Coform materials can have subsequent end uses which involve exposure of the structures to aqueous liquids including, but not limited to, normal tap water, waste water and body fluids such as blood and urine. Conventional coform fibrous nonwoven structures are used as absorbent products either alone, as in the form of wipers, or as components of other absorptive devices such as personal care absorbent articles including, but not limited to, diapers, training pants, incontinence garments, sanitary napkins, tampons, wound dressings, bandages and the like. It is desirable therefore, that the fibrous nonwoven composite structures of the present invention be able to withstand the rigors of their intended uses, and then, upon completion of the particular uses, the fibrous nonwoven web composite structures must become water-dispersible. To accomplish this, water-dispersible polymers employing a number of triggering mechanisms can be used as the polymers to form the water-dispersible reinforcing fibers of the fibrous nonwoven composite structure of the present invention.

Certain polymers are only water-dispersible when exposed to sufficient quantities of an aqueous liquid within a certain pH range. Outside this range, they will not degrade. Thus, it is possible to choose a pH-sensitive water-dispersible polymer which will not degrade in an aqueous liquid or liquids in one pH range, for example a pH of 3 to 5, but which will become dispersible in excess tap water. See for example, U.S. Pat. No. 5,102,668 to Eichel et al. Thus, when fibrous nonwoven composites are exposed to body fluids such as urine, the water dispersible reinforcing fibers will not degrade. Subsequent to its use, such a fibrous nonwoven composite structure can be placed in excess quantities of higher pH liquids such as tap water which will cause the degradation of the water-dispersible polymer making up the reinforcing fibers. As a result, the longer, more continuous reinforcing fibers will begin to break apart either by themselves or with sufficient agitation so that the discrete fibrous components, such as wood pulp fibers, can be reclaimed, recycled or disposed of by flushing. Examples of polymers which could be used to form this type of fiber could include acrylate ester/acrylic or methylacrylic acid copolymers and blends such as those designated as N-10, H-10 or X-10 as supplied by AtoFindley Adhesives, Inc., of Milwaukee, Wis. These materials are stable at body pH conditions (or when buffered against body fluids), but will break up in toilet water during the flushing process (excess water).

Another mechanism which can be used to trigger water degradability is ion sensitivity. Certain polymers contain acid-based ($R—COO^-$ or $R—SO_3^-$) components which are held together by hydrogen bonding. In a dry state, these polymers remain solid. In an aqueous solution which has a relatively high cation concentration, such as urine, the polymers still will remain relatively intact. However, when the same polymers are later exposed to larger quantities of water with diluted ion content, such as can be found in a toilet bowl, the cation concentration will be diluted and the hydrogen bonding will begin to break apart. As this happens the polymers, themselves, will begin to break apart in the water. See for example, U.S. Pat. No. 4,419,403 to Varona. Polymers that are stable in solutions with high cation concentrations (for example, baby or adult urine and menses) could be sulfonated polyesters such as are supplied by the Eastman Chemical Company of Kingsport, Tenn. under the codes AQ29, AQ38, or AQ55. The Eastman AQ38 polymer is composed of 89 mole percent isophthalic acid, 11 mole percent sodium sulfoisophthalic acid, 78 mole percent diethylene glycol and 22 mole percent 1,4-cyclohexanedimethanol. It has a nominal molecular weight of 14,000 Daltons, an acid number less than 2, a hydroxyl number less than 10 and a glass transition temperature of 38° C. Other examples could be blends of copolymers of poly (vinyl alcohol) blended with polyacrylic or methylacrylic acid or polyvinylmethyl ether blended with polyacrylic or methylacrylic acid. The Eastman polymers are stable in solutions with high cation concentrations, but will break-up rapidly if placed in sufficient excess water such as tap water to dilute the cation concentration. Other polymers that are usable as this type of ion trigger include proprietary copolyester blends, such as, but not limited to, NS-70-4395 and NS-70-4442, having different molecular weights and melt viscosities, available from National Starch and Chemical Company, which are materials defined by a narrow molecular weight blend.

Yet another means for rendering a polymer dispersible in water is through the use of temperature change. Certain polymers exhibit a cloud point temperature. As a result, these polymers will precipitate out of a solution at a particular temperature which is the cloud point. These polymers can be used to form fibers which are insoluble in water above a certain temperature but which become soluble and thus dispersible in water at a lower temperature. As a result, it is possible to select or blend a polymer which will not degrade in body fluids, such as urine, at or near body temperature (37° C.) but which will degrade when placed in water at temperatures below body temperature, for example at room temperature (23° C.). An example of such a polymer is polyvinylmethylether which has a cloud point of 34° C. When this polymer is exposed to body fluids such as urine at 37° C., it will not degrade as this temperature is above its cloud point (34° C.). However, if the polymer is placed in water at room temperature (23° C.), the polymer will, with time, go back into solution as it is not exposed to water at a temperature below its cloud point. Consequently, the polymer will begin to degrade.

Other cold water soluble polymers include poly(vinyl alcohol) graft copolymers supplied by the Nippon Synthetic Chemical Company, Ltd. of Osaka, Japan which are coded Ecomaty AX2000, AX 10000 and AX300G.

Other polymers are water-dispersible only when exposed to sufficient quantities of water. Thus, these types of polymers may be suitable for use in low water volume solution environments such as, but not limited, pantiliners, light incontinence products, baby or adult wipes, and the like. Examples of such materials could include NP2068, NP2074 or NP2120 aliphatic polyamides as supplied by the H. B. Fuller Company of Vadnais Heights, Minn., as discussed above.

Having described the various components which can be used to form a water-dispersible fibrous nonwoven composite structure according to the present invention, examples of several processes which could be used to form such materials will be described. One process for forming water-dispersible fibrous nonwoven web structures according to the present invention is shown in FIG. 1 of the drawings. In this drawing, a primary reinforcing polymer is extruded through a die head 10 into a primary gas stream 11 of high velocity, heated gas (usually air) supplied from nozzles 12 and 13 to attenuate the molten polymer into long, somewhat continuous fibers. As these water-dispersible primary reinforcing fibers are being formed, the primary gas stream 11 is merged with a secondary gas stream 14 containing staple fibers and individualized wood pulp fibers or other materials including particulates so as to integrate the different fibrous materials into a single fibrous nonwoven composite structure. The apparatus for forming and delivering the secondary gas stream 14 including the wood pulp fibers can be an apparatus of the type described and claimed in U.S. Pat. No. 3,793,678 to Appel. This apparatus comprises a conventional picker roll 20 having picking teeth for divellicating pulp sheets 21 into individual fibers. The pulp sheets 21 are fed radially, i.e., along a picker roll radius, to the picker roll 20 by means of rolls 22. As the teeth on the picker roll 20 divellicate the pulp sheets 21 into individual fibers, the resulting separate fibers are conveyed downwardly toward the primary air stream through a forming nozzle or duct 23. A housing 24 encloses the picker roll 20 and provides a passage 25 between the housing 24 and the picker roll surface. Process air is supplied to the picker roll in the passage 25 via duct 26 in sufficient quantity to serve as a medium for conveying the fibers through the forming duct 23 at a velocity approaching that of the picker teeth. The air may be supplied by a conventional means as, for example, a blower. The secondary reinforcing polymer fibers and the pulp fibers of the present invention may be mixed prior to merging with the primary gas stream 11 to form a coform blend. Alternatively, the secondary reinforcing fibers and pulp fibers can be added as two streams intersecting with the primary gas stream 11.

Mixing of the secondary reinforcing (staple) fibers and the pulp fibers can be achieved by any of several processes known to those skilled in the art. Such processes are used where two types of pulp material or a pulp and superabsorbent material are mixed prior to addition to the meltspun material. For example, in one mixing process a bale of staple fibers is picked and the staple fibers are blown into the pulp fiber airstream, mixing prior to addition to the meltspun airstream. In a different process the staple fibers are combined in the pulpboard formation in a conventional paper formation process. In any of the mixing processes, the ratio of staple to pulp can vary according to the material properties of the final fabric desired. Preferably, about 30% or less staple fiber is used in the staple/pulp blend.

As illustrated in FIG. 1, the primary and secondary gas streams 11 and 14 are preferably moving perpendicularly to each other at the point of merger, although other merging angles may be employed if desired to vary the degree of mixing and/or to form concentration gradients through the structure. The velocity of the secondary stream 14 is substantially lower than that of the primary stream 11 so that the integrated stream 15 resulting from the merger continues to flow in the same direction as the primary stream 11. The merger of the two streams is somewhat like an aspirating effect whereby the coform fiber blend (i.e., staple fiber and pulp blend) in the secondary stream 14 are drawn into the primary stream 11 as it passes the outlet of the duct 23. If a uniform structure is desired, it is important that the velocity difference between the two gas streams be such that the secondary stream is integrated with the primary stream in a turbulent manner so that the coform blend fibers in the secondary stream become thoroughly mixed with the meltblown fibers in the primary stream. In general, increasing velocity differences between the primary and secondary streams produce more homogenous integration of the two materials while lower velocities and smaller velocity differences will produce concentration gradients of components in the fibrous nonwoven composite structure. For maximum production rates, it is generally desirable that the primary air stream have an initial sonic velocity within the nozzles 12 and 13 and that the secondary air stream have a subsonic velocity. As the primary air stream exits the nozzles 12 and 13, it immediately expands with a resulting decrease in velocity.

Deceleration of the high velocity gas stream carrying the meltblown water-dispersible meltblown fibers frees the fibers from the drawing forces which initially form them from the water-dispersible polymer mass. As the water-dispersible reinforcing fibers relax, they are better able to follow the minute eddies and to entangle and capture the relatively short coform blend fibers while both fibers are dispersed and suspended in the gaseous medium. The resultant combination is an intimate mixture of coform blend fibers and water-dispersible primary reinforcing fibers integrated by physical entrapment and mechanical entanglement.

Attenuation of the water-dispersible primary reinforcing fibers occurs both before and after the entanglement of these fibers with the coform blend fibers. In order to convert the fiber blend in the integrated stream 15 into a fibrous nonwoven structure, the stream 15 can be passed into the nip of a pair of vacuum rolls 30 and 31 having foraminous surfaces that rotate continuously over a pair of fixed vacuum nozzles 32 and 33. As the integrated stream 15 enters the nip of the rolls 31 and 33, the carrying gas is sucked into the two vacuum nozzles 32 and 33 while the fiber blend is supported and slightly compressed by the opposed surfaces of the two rolls 30 and 31. This forms an integrated, self-supporting fibrous nonwoven composite structure 34 that has sufficient integrity to permit it to be withdrawn from the vacuum roll nip and conveyed to a wind-up roll 35. More preferably, rather than a pair of vacuum rolls 30 and 31, a foraminous collecting wire (not shown), known to those skilled in the art, is used.

Figure 2:
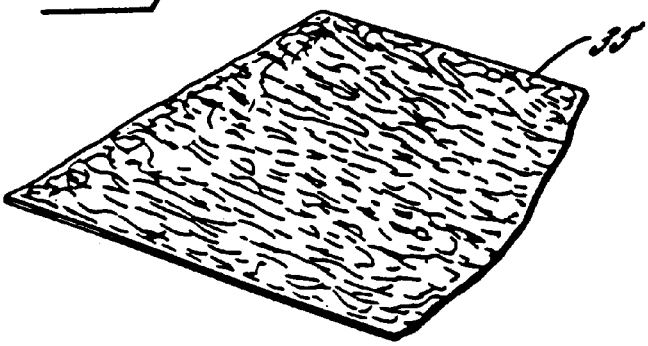
FIG. 2 is a perspective view of a fragment of a fibrous nonwoven composite structure produced by the method and apparatus of FIG. 1.

The containment of the coform blend fibers in the integrated primary reinforcing fiber matrix is obtained without any further processing or treatment of the air laid composite structure. However, if it is desired to improve the strength of the fibrous nonwoven composite structure 34, the composite web or structure 34 may be embossed or bonded using heat and/or pressure. The embossing may be accomplished using, for example, ultrasonic bonding and/or mechanical bonding as through the use of smooth and/or patterned bonding rolls which may or may not be heated. Such bonding techniques are well-known to those skilled in the art. In FIG. 1 the composite structure 34 is passed through an ultrasonic bonding station comprising an ultrasonic calendering head 40 vibrating against a patterned anvil roll 41. The bonding conditions (e.g., pressure, speed, power, and the like) as well as the bonding pattern may be appropriately selected to provide the desired characteristics in the final product. See FIG. 2.

The relative weight percentages of the water-dispersible reinforcing fibers and coform blend fibers may be varied according to the particular end use. Generally speaking, increasing the weight percent of the water-dispersible primary reinforcing fibers will increase the overall tensile strength and integrity of the resultant fibrous composite nonwoven structure.

A preferred formation process which can be used for forming water-dispersible fibrous nonwoven composites according to the present invention is shown in FIG. 3 of the drawings. In FIG. 3 there is shown an exemplary apparatus for forming an abrasion-resistant fibrous nonwoven composite structure which is generally represented by reference numeral 110. In forming the abrasion-resistant fibrous nonwoven composite structure of the present invention, pellets or chips, or the like (not shown) of a thermoplastic polymer are introduced into a pellet hoppers 112 of one or more extruders 114.

The extruders 114 have extrusion screws (not shown) which are driven by a conventional drive motor (not shown). As the polymer advances through the extruders 114, due to rotation of the extrusion screw by the drive motor, the polymer is progressively heated to a molten state. Heating the thermoplastic polymer to the molten state may be accomplished in a plurality of discrete steps with its temperature being gradually elevated as it advances through discrete heating zones of the extruder 114 toward two meltblowing dies 116 and 118, respectively. The meltblowing dies 116 and 118 may be yet another heating zone wherein the temperature of the thermoplastic resin is maintained at an elevated level for extrusion.

Each meltblowing die is configured so that two streams of usually heated attenuating gas per die converge to form a single stream of gas which entrains and attenuates the molten threads of primary reinforcing polymer, as the threads exit small holes or orifices 124 in the meltblowing die. The molten threads are attenuated into fibers 120, or depending upon the degree of attenuation, microfibers, of a small diameter which is usually less than the diameter of the orifices 124. Thus, each meltblowing die 116 and 118 has a corresponding single stream of gas 126 and 128 containing entrained and attenuated polymer fibers. The gas streams 126 and 128 containing polymer fibers are aligned to converge at an impingement zone 130.

One or more types of coform blend (staple polymer and pulp) fibers 132 and/or particulates are added to the two streams 126 and 128 of primary reinforcing polymer fibers or microfibers 120 at the impingement zone 130. Introduction of the coform blend fibers 132 into the two streams 126 and 128 of the primary reinforcing polymer fibers 120 is designed to produce a graduated distribution of coform blend fibers 132 within the combined streams 126 and 128 of primary reinforcing fibers. This may be accomplished by merging a secondary gas stream 134 containing the coform blend fibers 132 between the two streams 126 and 128 of primary reinforcing polymer fibers 120 so that all three gas streams converge in a controlled manner.

Apparatus for accomplishing this merger may include a conventional picker roll 136 arrangement which has a plurality of teeth 138 that are adapted to separate a mat or batt 140 of coform blend fibers into the individual coform blend fibers 132. The mat or batt of coform blend fibers 140 which is fed to the picker roll 136 may be a sheet of pulp fibers (if a two-component mixture of secondary reinforcing fibers and pulp fibers is desired). In embodiments where, for example, an absorbent material is desired, the coform blend fibers 132 are absorbent fibers and the polymer material as described above. The staple fibers of the coform blend fibers 132 may be as described above.

The sheets or mats 140 of coform blend fibers 132 may be fed to the picker roll 136 by a roller arrangement 142. After the teeth 136 of the picker roll 136 have separated the mat of coform blend fibers 140 into separate coform blend fibers 132 the individual coform blend fibers 132 are conveyed toward the stream of thermoplastic polymer fibers or microfibers 120 through a nozzle 144. A housing 146 encloses the picker roll 136 and provides a passageway or gap 148 between the housing 146 and the surface of the teeth 138 of the picker roll 136. A gas such as air is supplied to the passageway or gap 148 between the surface of the picker roll 136 and the housing 146 by way of a gas duct 150. The gas duct 150 may enter the passageway or gap 148 generally at the junction 152 of the nozzle 144 and the gap 148. The gas is supplied in sufficient quantity to serve as a medium for conveying the coform blend fibers 132 through the nozzle 144. The gas supplied from the duct 150 also serves as an aid in removing the coform blend fibers 132 from the teeth 138 of the picker roll 136. The gas may be supplied by any conventional arrangement such as, for example, an air blower (not shown). It is contemplated that additives and/or other materials may be added to or entrained in the gas stream to treat the coform blend fibers 132 or to provide desired properties in the resultant web.

Generally speaking, the individual coform blend fibers 132 are conveyed through the nozzle 144 at about the velocity at which the coform blend fibers 132 leave the teeth 138 of the picker roll 136. In other words, the coform blend fibers 132, upon leaving the teeth 138 of the picker roll 136 and entering the nozzle 144 generally maintain their velocity in both magnitude and direction from the point where they left the teeth 138 of the picker roll 136. Such an arrangement, which is discussed in more detail in U.S. Pat. No. 4,100,324 to Anderson, et al. aids in substantially reducing fiber floccing.

The width of the nozzle 144 should be aligned in a direction generally parallel to the width of the meltblowing dies 116 and 118. Desirably, the width of the nozzle 144 should be about the same as the width of the meltblowing dies 116 and 118. Usually, the width of the nozzle 144 should not exceed the width of the sheets or mats 140 that are being fed to the picker roll 136. Generally speaking, it is desirable for the length of the nozzle 144 separating the picker from the impingement zone 130 to be as short as equipment design will allow.

The picker roll 136 may be replaced by a conventional particulate injection system to form a fibrous nonwoven composite structure 154 containing various secondary particulates (for example, superabsorbents, as described above). A combination of both secondary particulates and coform blend fibers could be added to the primary reinforcing polymer fibers 120 prior to formation of the fibrous nonwoven composite structure 154 if a conventional particulate injection system was added to the system illustrated in FIG. 3.

Due to the fact that the water-dispersible thermoplastic polymer fibers in the fiber streams 126 and 128 are usually still semi-molten and tacky at the time of incorporation of the coform blend fibers 132 into the fiber streams 126 and 128, the coform blend fibers 132 are usually not only mechanically entangled within the matrix formed by the water-dispersible fibers 120 but are also thermally bonded or joined to the primary reinforcing fibers.

In order to convert the composite stream 156 of primary reinforcing fibers 120 and coform blend fibers 132 into a fibrous nonwoven composite structure 154 composed of a coherent matrix of the primary reinforcing fibers 120 having the coform blend fibers 132 distributed therein, a collecting device is located in the path of the composite stream 156. The collecting device may be an endless foraminous belt 158 conventionally driven by rollers 160 and which is rotating as indicated by the arrow 162 in FIG. 3. Other collecting devices are well known to those of skill in the art and may be utilized in place of the endless belt 158. For example, a porous rotating drum arrangement could be utilized. The merged streams of primary reinforcing fibers and coform blend fibers are collected as a coherent matrix of fibers on the surface of the endless belt 158 to form the fibrous nonwoven composite structure or web 154. Vacuum boxes 164 assist in retention of the matrix on the surface of the belt 158. The vacuum may be set at about 2.5 to about 10 centimeters of water column.

The fibrous nonwoven composite structure 154 is coherent and may be removed from the belt 158 as a self-supporting nonwoven material. Generally speaking, the fibrous nonwoven composite structure 154 has adequate strength and integrity to be used without any post-treatments such as pattern bonding and the like. If desired, a pair of pinch rollers or pattern bonding rollers (not shown) may be used to bond portions of the material. Although such treatment may improve the integrity of the fibrous nonwoven composite structure 154 it also tends to compress and densify the structure.

Besides the foregoing processes, there are a number of other processes which are suitable for making various types of coform materials. For example, McFarland et al., U.S. Pat. No. 4,604,313 issued Aug. 5, 1986, is directed to a process for forming a multi-layered coform material including meltblown fibers and wood pulp fibers in one layer and a second layer which contains meltblown fibers, wood pulp fibers and superabsorbent particles. Another process is disclosed in Eschwey et al., U.S. Pat. No. 4,902,559 issued Feb. 20, 1990. This patent discloses a process wherein endless filaments are spun through a long spinneret into a passage to form what are more commonly referred to as spunbond fibers. At the same time, smaller hydrophilic or oleophilic fibers are fed into the stream of spunbond fibers. Optionally, superabsorbent particles may also be introduced into the foregoing fiber mixture.

An important aspect of the present invention is the novel use of a hybrid bonding system to balance tensile strength, softness and water dispersibility. Heretofore only single or crude double bonding systems were used to impart tensile strength. The present invention presents a process whereby a first bonding occurs during the addition of secondary reinforcing fibers into the airstream of primary reinforcing fibers, whereby the secondary reinforcing fibers become entangled, entrapped and otherwise stuck to the primary reinforcing fibers. The second bonding occurs when the composite fiber fabric is softened using thermal or ultrasonic energy above the softening point of only one of the primary or secondary reinforcing polymers and below that of the softening point of the other reinforcing polymer, whereupon the fibers which soften bond to the other fiber. In a preferred embodiment the secondary reinforcing material polymer has a softening point of not less than about 30° C. lower than the softening point of the primary reinforcing polymer material. In such case, the primary reinforcing fibers remain unsoftened and unmelted, resulting in a bonding producing increased tensile strength, yet freedom of movement of the primary reinforcing fibers. Where the softening point of the secondary reinforcing material polymer is at least about 30° C. above that over the primary reinforcing, the primary reinforcing material softens and bonds, creating the tensile strength, while the secondary reinforcing material maintains freedom of movement. It is the balance of tensile strength, softness and water-dispersibility that is struck by the composition of the materials and the bonding system of the present invention. Conventional meltblown materials used in wet wipes are weaker because they are composed of a finer denier and of material that allows for dispersion in water. Unfortunately, such weak materials do not produce wet wipes having sufficient strength to withstand normal usage. The fabric of the present invention is stronger because of the addition of the secondary reinforcing material. The use of secondary reinforcing fibers of having a length of about 15 mm or less reduces the possibility of tangling and twisting of fabric formed therefrom in a plumbing/sewer system. Additionally, such sized fibers produce a water-dispersible fabric pieces of a desirable size.

The material of the present invention can be used in a number of articles, including, but not limited to baby wipes, adult wipes, feminine protection articles, industrial cleaning wipes, dressings, absorbent gauzes, and the like.

Having described various components and processes which can be used to form water-dispersible fibrous nonwoven composite structures according to the present invention, a series of Examples were prepared to demonstrate the present invention. Parts and percentages appearing in such examples are by weight unless otherwise stipulated.

EXAMPLES

Testing methods:

Strip Tensile test: The strip tensile test is a measure of breaking strength and elongation or strain of a fabric when subjected to unidirectional stress. This test is known in the art. The results are expressed in grams to break and percent elongation before breakage. Higher numbers indicate a stronger fabric. The term "load" means the maximum load or force, expressed in units of weight, required to break or rupture the specimen in a tensile test. The term "strain" or "total energy" means the total energy under a load versus elongation curve as expressed in weight-length units. The term "elongation" means the increase in length of a specimen during a tensile test. Values for strip tensile strength and strip elongation are obtained using a specified width of fabric, usually 2 inches (50 mm), the same clamp width and a constant rate of extension. The sample is the same width as the clamp to give results representative of effective strength of fibers in the clamped width. The specimen is clamped in, for example, a constant-rate-of-extension tensile tester, designated as Sintech 2, Model 3397-139, available from Sintech Corporation, Cary, N.C., which has 2 inch (51 mm) long parallel clamps. This closely simulates fabric stress conditions in actual use.

Example 1

Sample 1 was made of 50% National Starch and Chemical Company code number NS 70-4395 primary reinforcing polymer and 50% of secondary reinforcing polymer/pulp mix. The secondary reinforcing polymer/pulp mix was composed of 80% CR 54 pulp, available from Kimberly-Clark Corporation, Neenah, Wis. and 20% of a 5 denier, 6 mm polyester provided by Minifibers Ltd. Also included was 1.5 kg/ton Berocel™ debonder (available from Akzo Nobel Chemical), which enhances fiberization by the picker.

Sample 2 was made of 40% NS 70-4395 primary reinforcing polymer and 60% of secondary reinforcing polymer/pulp mix. The secondary reinforcing polymer/pulp mix was composed of 80% CR 54 pulp and 20% of a 5 denier, 6 mm polyester provided by Minifibers, Ltd. Also included was 1.5 kg/ton Berocel™ debonder.

The absorbent structure was produced utilizing a twin extruder and a pulp fiberizer system such as shown in FIG. 3. The coformed composites were formed on either a porous tissue carrier sheet or a spunbonded polypropylene nonwoven web carrier sheet. Optionally, the coform composites can be formed directly onto a forming wire. Basis weights of the coformed absorbent structures were 70 grams per square meter (gsm). The absorbent structures were then pattern bonded in a separate process using a heated calendar nip with a total bond area of approximately 20 percent. The pattern roll was set at 91.6° C. (205° F.), the anvil roll was set at 79.4° C.–90.5° C. (175–195° F.), the pressure was 10 psig (703 g/cm$^2$) (18 lb/lineal inch). A range of 15–30 lbs/lineal inch appeared to be usable. See, for example, U.S. Pat. No. D315,990, issued Apr. 9, 1991, to Blenke et al.

Table 1 shows the summary of aging data. Tensile was measured in grams/25 mm-width.

TABLE 1

| | Tensile | | | |
|---|---|---|---|---|
| | Sample 1 (50/50 NS 70-4395 pulp-polyester blend) | | Sample 2 (60/40 NS 70-4395 pulp-polyester blend) | |
| Aging Time (weeks) | In storage solution | 5 min. in tap water | In storage solution | 5 min. in tap water |
| 0 | 179 | 111 | 72 | 62 |
| 2 | 164 | 122 | 83 | 72 |
| 4 | 162 | 130 | 85 | 62 |

The storage solution was Natural Care™ solution available from Kimberly-Clark Corporation, Neenah, Wis., with 1% sodium sulfate added (as a trigger preservative). Tensile tests performed on a Sintech Tensile Tester used a 50 lb (22,680 grams) load-cell, with jaw separation speed of 12 inches/minute (30.48 cm/min.), and a jaw span of 2 inches (4.508 cm.).

Sample 1 had an average dry tensile after embossing of 1386 g/2.54 cm in the machine direction and 574 g/2.54 cm in the cross direction. Sample 2 had an average dry tensile after embossing of 955 g/2.54 cm in the machine direction and 255 g/inch in the cross direction.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

It should further be noted that any patents, applications or publications referred to herein are incorporated by reference in their entirety.

What is claimed is:

1. A water-dispersible fibrous nonwoven composite structure, comprising:

a) a primary reinforcing material comprising polymer fibers;

b) a secondary reinforcing material comprising polymer fibers, said secondary reinforcing material polymer fibers having an average fiber length less than equal to about 15 mm, and said secondary reinforcing material having a softening point less than the softening point of said primary reinforcing material such that when said structure is heated said secondary material softens and bonds to said primary reinforcing material, and said primary reinforcing material does not appreciably soften; and, c) an absorbent material, wherein said structure is stable in an aqueous environment containing a high ion concentration and disperses in an aqueous environment containing a diluted ion concentration.

2. The structure of claim 1, wherein said primary reinforcing material is a material capable of being meltspun.

3. The structure of claim 1, wherein said primary reinforcing material is meltable and water dispersible.

4. The structure of claim 1, wherein said primary reinforcing material is a material selected from the group consisting of polyesters, copolyesters, polyamides, copolyamides, polyethylene terephthalates, vinyl alcohols, co-poly(vinyl alcohol), acrylates, methacrylates, cellulose esters, a blend of at least two of these materials, and copolymers of acrylic acid and methacrylic acid.

5. The structure of claim 1, wherein fibers formed from said primary reinforcing material have an average diameter of less than about 100 micrometers.

6. The structure of claim 1, wherein fibers formed from said primary reinforcing material have an average diameter of less than about 15 micrometers.

7. The structure of claim 1, wherein said secondary reinforcing material is a polymer selected from the group consisting of polyolefins, polyesters, polyether block amides, nylons, poly(ethylene-co-vinyl acetate), polyurethanes, co-poly(ether/ester), and bicomponent and multicomponent materials made therefrom.

8. The structure of claim 1, wherein said secondary reinforcing material has a softening point about 50° C. above to about 50° C. below the softening point of said primary reinforcing material.

9. The structure of claim 1, wherein said secondary reinforcing material has a softening point equal to or at least about 30° C. lower than the softening point of said primary reinforcing material.

10. The structure of claim 1, wherein said primary reinforcing material has a softening point equal to or at least about 30° C. lower than the softening point of said secondary reinforcing material.

11. The structure of claim 1, wherein said secondary reinforcing material has a softening point of from about 50° C. to about 200° C., as measured by the ASTM (Vicat) Test Method D-1525.

12. The structure of claim 1, wherein said secondary reinforcing material has a softening point of about 88° C., as measured by the ASTM (Vicat) Test Method D-1525.

13. The structure of claim 1, wherein said secondary reinforcing material comprises a plurality of different polymers.

14. The structure of claim 1, wherein said secondary reinforcing material has an average fiber length of about 6 mm.

15. The structure of claim 1, wherein said absorbent material is selected from the group consisting of a superabsorbent material, wood fiber, pulp, particulate matter, and an odor reducing agent.

16. The structure of claim 1, wherein said absorbent material has an average length of about 0.5 to about 10 millimeters.

17. The structure of claim 1, wherein said absorbent material has an average length-to-maximum width ratio of about 10:1 to about 400:1.

18. The structure of claim 1, wherein said primary reinforcing material is present in a concentration of from about 30% to about 35% said secondary reinforcing material is present in a concentration of from about 5% to about 8%, and said absorbent material is present in a concentration of from about 20% to about 80%.

19. The structure of claim 1, wherein said primary reinforcing material is present in a concentration of from about 30% to about 35% said secondary reinforcing material is present in a concentration of from about 5% to about 8%, and said absorbent material is present in a concentration of from about 40% to about 60%.

20. A personal care absorbent article which includes a water-dispersible fibrous nonwoven structure according to claim 1.

21. The personal care absorbent article of claim 20, wherein said article is selected from the group consisting of a wipe, a diaper, a training pant, a pantiliner, a sanitary napkin, an incontinence device, a wound dressing and a bandage.

22. A flushable article produced by a method, comprising:

a) providing a primary reinforcing material;

b) providing a secondary reinforcing material comprising polymer fibers, said secondary reinforcing material polymer fibers having an average fiber length less than or equal to about 15 mm;

c) providing an absorbent material;

d) forming a mixture of said secondary reinforcing material and said absorbent material;

e) forming a fiber stream composed of meltspun primary reinforcing material;

f) adding an effective amount of the mixture of step d) to said fiber stream;

g) forming a fibrous nonwoven structure from the fiber steam of step f); and, h) exposing said nonwoven structure of step g) to a source of energy selected from the group consisting of thermal energy and ultrasonic energy such that only one of said primary and secondary reinforcing materials softens and bonds to the other material, while the other reinforcing material remains substantially unsoftened, wherein said structure is stable in an aqueous environment containing a high ion concentration and disperses in an aqueous environment containing a diluted ion concentration.

23. A flushable article containing a fibrous nonwoven material, said nonwoven material comprising water-dispersible fibrous nonwoven composite structure, comprising:

a. a primary reinforcing material comprising polymer fibers;

b. a secondary reinforcing material comprising polymer fibers, said secondary reinforcing material polymer fibers having an average fiber length less than or equal to about 15 mm; and said secondary reinforcing material having a softening point less than the softening point of said primary reinforcing material such that when said structure is heated said secondary material softens and bonds to said primary reinforcing material, and said primary reinforcing material does not appreciably soften; and c. an absorbent material, whereby said flushable article is capable of being flushed down a commode and associated plumbing and piping, entering a sewer system without clogging said plumbing and said piping, and dispersing into pieces no larger than about 25 mm in diameter, and whereby said water-dispersible fibrous nonwoven composite structure is stable in an aqueous environment containing a high ion concentration and disperses in an aqueous environment containing a diluted ion concentration.

* * * * *